US009293895B2

(12) United States Patent
Pucciani et al.

(10) Patent No.: US 9,293,895 B2
(45) Date of Patent: Mar. 22, 2016

(54) IONIZING BAR FOR AIR NOZZLE MANIFOLD

(71) Applicant: Illinois Tool Works Inc., Glenview, IL (US)

(72) Inventors: Allen S. Pucciani, Beavercreek, OH (US); John A. Gorczyca, Lansdale, PA (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 32 days.

(21) Appl. No.: 14/278,601

(22) Filed: May 15, 2014

(65) Prior Publication Data

US 2014/0338535 A1 Nov. 20, 2014

Related U.S. Application Data

(60) Provisional application No. 61/824,587, filed on May 17, 2013, provisional application No. 61/887,543, filed on Oct. 7, 2013.

(51) Int. Cl.
*H01T 23/00* (2006.01)
*H01T 19/04* (2006.01)

(52) U.S. Cl.
CPC ..... *H01T 23/00* (2013.01); *H01T 19/04* (2013.01)

(58) Field of Classification Search
CPC combination set(s) only.
See application file for complete search history.

(56) References Cited

U.S. PATENT DOCUMENTS

| | | | |
|---|---|---|---|
| 1,396,210 | A | 11/1921 | Alfred |
| 2,166,300 | A | 7/1939 | Komar |
| 3,034,645 | A | 5/1962 | Groppe |
| 2,645,528 | A | 7/1963 | Thorsen |
| 3,272,176 | A | 9/1966 | Saydlowski |
| 3,503,554 | A | 3/1970 | Clifton |
| 3,510,065 | A | 5/1970 | Giagantino et al. |
| 3,974,091 | A | 8/1976 | Parker et al. |
| 4,322,384 | A | 3/1982 | Sutton |
| 4,515,313 | A | 5/1985 | Cavanagh |
| 4,813,611 | A | 3/1989 | Fontana |
| 5,015,372 | A | 5/1991 | Mercer et al. |
| 5,064,118 | A | 11/1991 | Lauricella |
| 5,575,423 | A | 11/1996 | Yuen |
| 5,680,993 | A | 10/1997 | McCracken et al. |
| 6,145,650 | A | 11/2000 | Christ et al. |
| 6,401,904 | B1 | 6/2002 | Risley |
| 8,382,013 | B2 | 2/2013 | Pucciani |
| 2008/0190294 | A1 | 8/2008 | Sato et al. |
| 2010/0163653 | A1 | 7/2010 | Pucciani |
| 2012/0315123 | A1 | 12/2012 | Pucciani |

FOREIGN PATENT DOCUMENTS

| | | | |
|---|---|---|---|
| AU | 467689 | B2 | 12/1975 |
| DE | 4329193 | A1 | 3/1995 |
| FR | 1422259 | A | 12/1965 |
| JP | H04 370697 | A | 12/1992 |
| WO | 2012057704 | A1 | 5/2012 |
| WO | 2012170660 | A1 | 12/2012 |
| WO | 2013046735 | A1 | 4/2013 |

OTHER PUBLICATIONS

Int'l Search Report and Written Opinion issued Oct. 9, 2014 in Int'l Application No. PCT/US2014/038471.

*Primary Examiner* — Duane Smith
*Assistant Examiner* — Sonji Turner
(74) *Attorney, Agent, or Firm* — Panitch Schwarze Belisario & Nadel LLP

(57) ABSTRACT

A processing system includes an air blower and an air manifold with a main body having an inlet coupled to the air blower and a plurality of outlet openings. Each of the outlet openings is coupled to a nozzle. An ionizer bar includes a housing, a power cable contained within the housing, and a plurality of emitter pins electrically coupled to the power cable. A cartridge includes two side plates forming a channel in which the ionizer bar is mounted. The cartridge is removably couplable to an interior of the main body of the air manifold.

18 Claims, 6 Drawing Sheets

IONIZING BAR FOR AIR NOZZLE MANIFOLD

CROSS-REFERENCE TO RELATED APPLICATIONS

This application claims the benefit of U.S. Provisional Patent Application No. 61/824,587, entitled "Ionizing Bar for Air Nozzle Manifold," filed on May 17, 2013, and the benefit of U.S. Provisional Patent Application No. 61/887,543, entitled "Ionizing Bar for Air Nozzle Manifold," filed on Oct. 7, 2013, the entire contents of all of which are incorporated by reference herein.

BACKGROUND OF THE INVENTION

Embodiments of the present invention relate generally to air cleaning and static neutralizing systems, and more particularly, to an ionizing bar mounted into an air nozzle manifold.

Conventional bottle or can-filling applications often utilize compressed air to clean the bottles or cans on the assembly line prior to filling. Similarly, it is often desirable to neutralize static electricity which builds up or is otherwise introduced in the bottles or cans during a filling operation. Discrete nozzles were therefore used to blow ionized compressed air into the bottles or cans to accomplish both tasks at once. However, these solutions are costly due to the use of compressed air and the cost for powering the electrical components of the discrete nozzles. Maintenance is also difficult to perform on the discrete nozzles.

Alternatives to compressed air nozzles, such as air manifolds having a series of nozzles, air knives, or the like, may be used to direct air received at an inlet from a blower. It is desirable to provide a cleaning and static neutralizing system that utilizes blown, rather than compressed, air, and which allows for the use of an efficient static neutralizing device that is simple to manage and service as part of the blown air system without compromising the desired effects of the blown air.

BRIEF SUMMARY OF THE INVENTION

Briefly stated, an embodiment of the present invention comprises a processing system including an air blower and an air manifold including a main body having an inlet coupled to the air blower and a plurality of outlet openings. Each of the outlet openings is coupled to a nozzle. An ionizer bar includes a housing, a power cable contained within the housing, and a plurality of emitter pins electrically coupled to the power cable. A cartridge includes two side plates forming a channel in which the ionizer bar is mounted. The cartridge is removably couplable to an interior of the main body of the air manifold.

BRIEF DESCRIPTION OF THE SEVERAL VIEWS OF THE DRAWINGS

The foregoing summary as well as the following detailed description of preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
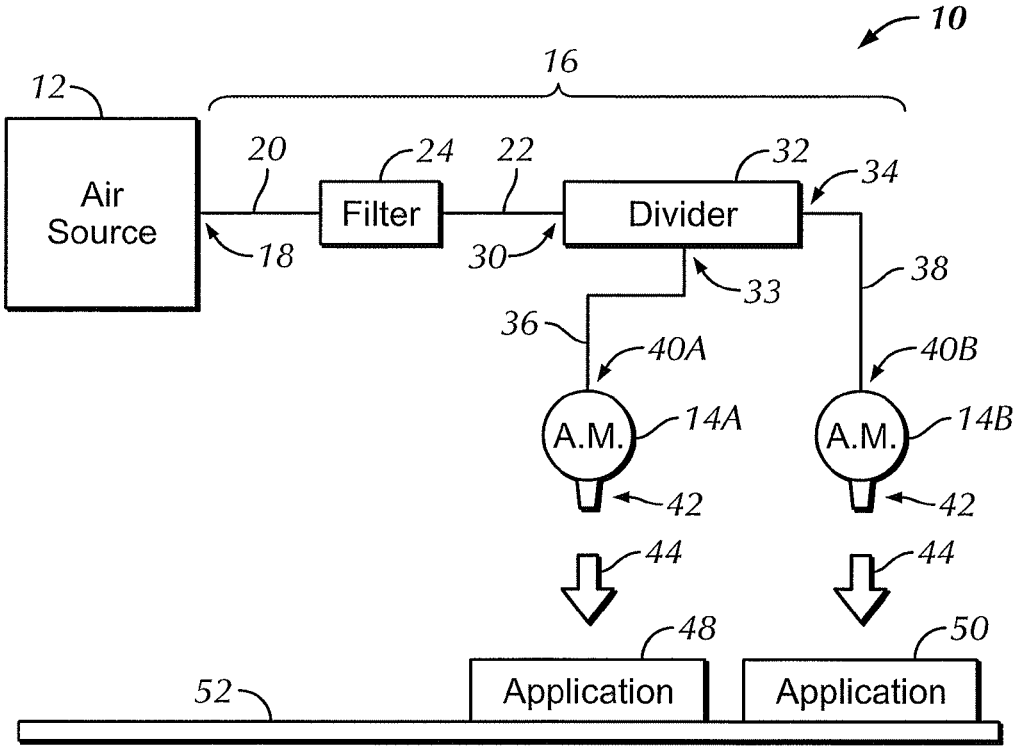
FIG. 1 is a schematic diagram of a processing system in accordance with a first preferred embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the device and designated parts thereof. Unless specifically set forth herein, the terms "a", "an" and "the" are not limited to one element but instead should be read as meaning "at least one". The terminology includes the words noted above, derivatives thereof and words of similar import.

Referring to the drawings, wherein the same reference numerals are used to designate the same components throughout the several figures, there is shown in FIG. 1 a processing system 10 that includes an air supply source 12 configured to deliver a fluid (e.g., air) to air manifolds 14A and 14B along a flow path 16. In the illustrated embodiment, the flow path 16 includes fluid conduits 20, 22, 36, and 38, a filter 24, and a divider 32.

The air supply source 12 may include a high flow centrifugal blower ("air blower") which, in some embodiments, may include a supercharger and motor configuration. In one embodiment, the operating characteristics of the air blower 12 may provide an air flow having a pressure of between approximately 1-10 pounds per square inch (psi) and having a flow rate of between approximately 50-2000 cubic feet per minute (CFM) or more specifically, between approximately 150 to 1500 CFM. In some embodiments, the air blower 12 may be housed within an enclosure. The air blower 12 may be separated from the air manifolds 14A and 14B by a distance of 10, 20, 30, 40, 50, 100, or 200 feet or more. As such, the flow path 16 is configured to provide a path through which air provided by the air blower 12 may be routed and ultimately delivered to the air manifolds 14A and 14B.

The air blower 12 may include an outlet 18 coupled to the fluid conduit 20 that defines a first portion of the flow path 16. The fluid conduit 20 may be a hose, such as a flexible hose, a pipe, such as a stainless steel pipe or a polyvinyl chloride (PVC) pipe, ductwork, or the like. Adapters (not shown) may be used in the flow path 16 to provide an interface for coupling dissimilar conduit materials, such as a hose and a pipe. A filter 24 is preferably disposed downstream of the air blower 12. As shown in FIG. 1, the filter 24 is interposed between the conduits 20, 22. Operation of the filter 24 will be described in further detail below.

The flow path 16 continues to the distal end of the conduit 22, which may be coupled to an inlet 30 of a flow divider 32 that receives the air flow. The flow divider 32 may be configured to distribute or split the air flow to multiple outlets 33 and 34. Additional fluid conduits 36 and 38 may respectively couple the outlets 33 and 34 to the air manifolds 14A and 14B, respectively. In the illustrated embodiment, the air manifolds 14A and 14B may each include an inlet (40A and 40B) configured for a hose connection, and the fluid conduits 36 and 38 may thus be provided as hoses, such as flexible hoses or the like. In other embodiments, a pipe may be disposed between the divider 32 and one of the air manifolds 14A or 14B, whereby adapters (not shown) are coupled to each end of the pipe to facilitate a fluid connection between hoses extending from an outlet (e.g., 33 or 34) of the divider 32 and from an inlet (e.g., 40A or 40B) of one of the air manifolds (e.g., 14A or 14B). In some embodiments, the system 10 may include only a single air manifold (e.g., 14A) and thus may not include a divider 32. In such embodiments, the fluid conduit 22 may be coupled directly to the air manifold 14A.

As shown in FIG. 1, the air flow 44 exiting the air manifolds 14A and 14B may be directed towards applications 48 and 50, respectively, of the processing system 10. For example, the applications 48, 50 may be transported through the system 10 along a conveyor belt 52 or other suitable type of transport mechanism. As will be appreciated, the system 10 may utilize the air flow 44 provided by the air manifolds 14A and 14B, respectively, for a variety of functions, including but not limited to drying products, removing dust or debris, coating control, cooling, leak detection, surface impregnation, corrosion prevention, and the like. For example, in certain embodiments, the system 10 may be used for drying food or beverage containers, such as cans or bottles, or may be a system for removing dust and other debris from sensitive electronic products, such as printed circuit boards (PCBs) or the like. In addition, some embodiments of the system 10 may also utilize the air flow 44 to clean and/or remove debris from the conveyer belt 52.

Figure 2:
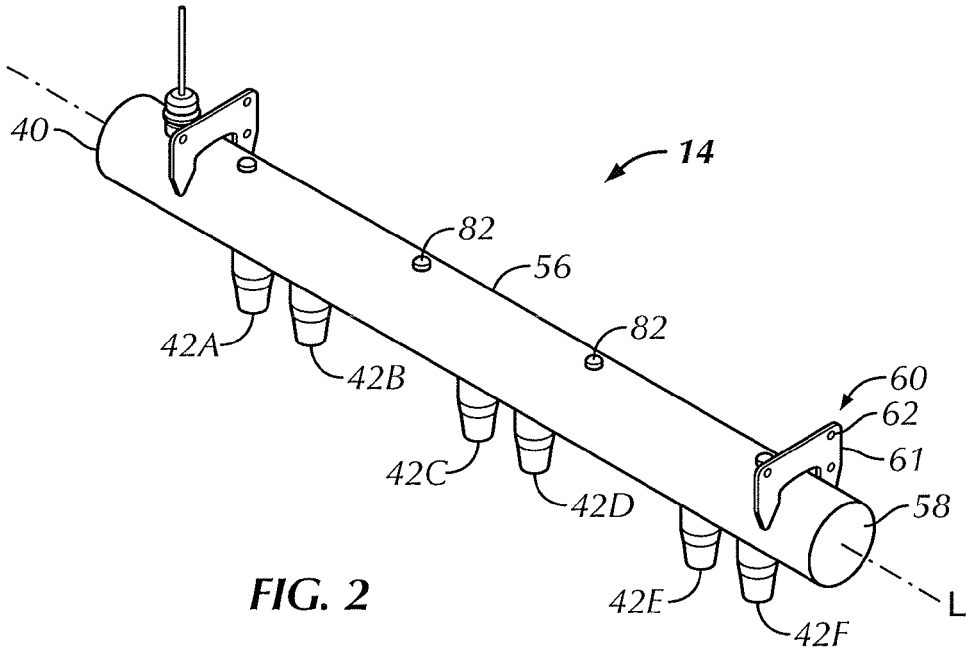
FIG. 2 is a front side perspective view of an air manifold in accordance with the first preferred embodiment of the present invention.
Figure 3:
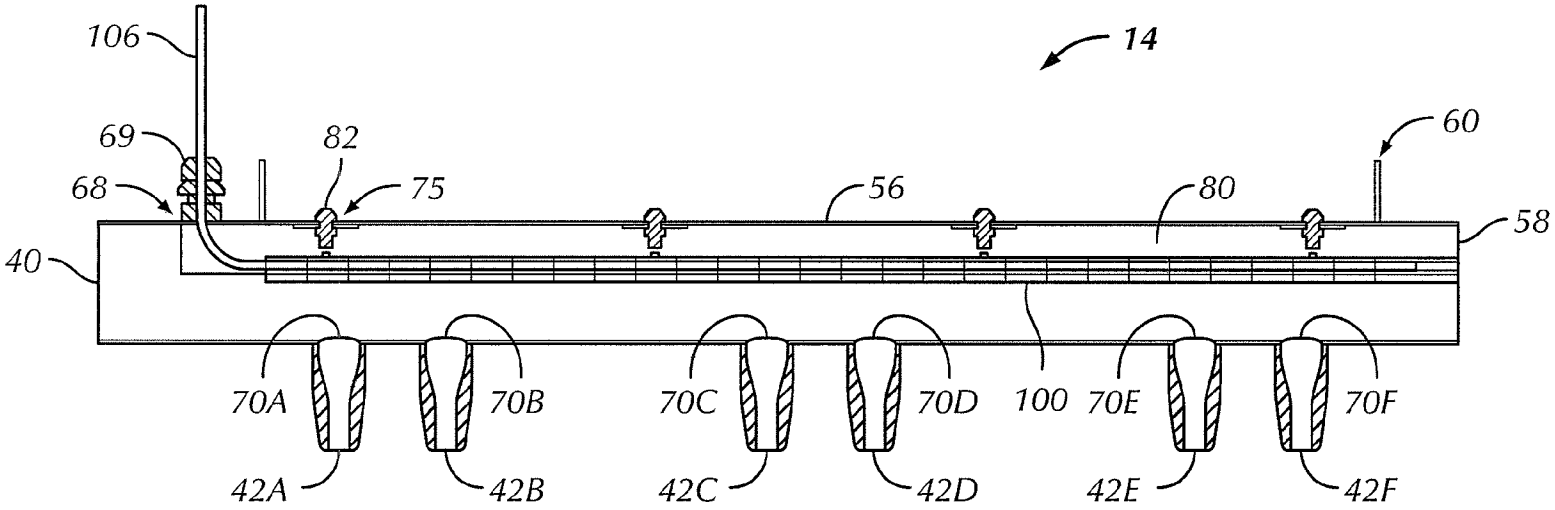
FIG. 3 is a cross-sectional front side elevational view of the air manifold of FIG. 2 with the ionizer bar installed.

FIGS. 2 and 3 show a preferred embodiment of the air manifold 14 for use in the system 10 of FIG. 1. The air manifold 14 includes a main body or housing 56 which includes an axial length (e.g., measured along the longitudinal axis L) preferably between approximately 0.5 feet to 4 feet (e.g., 0.5, 1, 1.5, 2, 2.5, 3, 3.5, or 4 feet), although other axial lengths of the main body 56 may be used as well. For example, in some embodiments, the length may also be greater than 4 feet (e.g., 5, 6, 7, 8 feet, or the like).

The main body 56 in the depicted embodiment is generally cylindrical in shape (e.g., having a generally circular cross section). In other embodiments, the main body 56 may have an oval-shaped cross-section, a diamond-shaped cross-section, a triangular-shaped cross-section, a square or rectangular-shaped cross-section, or the like. A first end of the main body 56 is open and forms the inlet 40. As described above, air supplied by the air source 12 may be routed to the air manifold 14 through the inlet 40 and discharged via a plurality of nozzles 42A-42F. For example, the inlet 40 may be coupled to a fluid conduit (e.g., conduit 36). A second end (a sealed end) of the main body 56 that is opposite the inlet 40 may be sealed by an end cap 58. In certain embodiments, the end cap 58 may have a shape that is generally the same as the cross-sectional shape of the main body 56 (e.g., circular). The end cap 58 may be joined to the main body 56 by welding (e.g., tungsten inert gas (TIG) welding), fastened to the main body 56 using one or more screws, bolts, or any other suitable type of fastener, adhesive, or the like.

In some embodiments, the main body 56 of the air manifold 14 may include one or more mounting brackets 60 for mounting of the air manifold 14 to an assembly line. The mounting brackets 60 are preferably welded to the main body 56, although other methods of connection, such as adhesive, mechanical fasteners, or the like may be used to secure the brackets 60 to the main body 56. In the embodiment shown, the mounting brackets 60 are each formed by a plate 61 extending radially outwardly from the main body 56, and each includes a plurality of through-holes 62 for receiving mounting screws (not shown) or like mechanical fasteners for securing the plate 61 to a support (not shown). Other types of mounting brackets 60, including those allowing movement of the main body 56 with respect to the support, including rotational movement, sliding movement, or the like, may also be used.

The inlet 40 and the main body 56 are depicted in FIGS. 2 and 3 as having respective diameters that are preferably equal. In one embodiment, the diameters of the inlet 40 and the main body 56 are between approximately 1 to 6 inches. In other embodiments, the diameters of the inlet 40 and the main body 56 may be different sizes. Further, in some embodiments, the diameter of the main body 56 may vary along the length L thereof. For example, the diameter of the main body 56 may progressively decrease or increase from the inlet 40 end to the sealed end (e.g., having the end cap 58).

The nozzles 42A-42F extend radially outwardly from the main body 56. The main body 56 includes a plurality of openings 70A-70F (FIG. 3), each of which corresponds to a respective one of the nozzles 42A-42F. Inlet ends of the nozzles 42A-42F may be welded to the main body 56 via TIG welding or a like attachment process such that air flowing into the main body 56 of the air manifold 14 via the inlet 40 may flow through the openings 70A-70F of the main body 56 and into the respective nozzles 42A-42F. That is, each nozzle 42A-42F and its respective opening 70A-70F on the main body 56 defines a flow path by which air within the main body 56 may be discharged from the air manifold 14.

While the depicted embodiment of FIGS. 2 and 3 includes six nozzles (42A-42F), it should be appreciated that various embodiments may provide any suitable number of nozzles. For example, certain embodiments may include 2 to 20 nozzles or more. The nozzles 42A-42F may be axially spaced apart along the length L of the main body 56, such that each nozzle 42A-42F is separated in the axial direction. The distances between adjacent nozzles 42A-42F may be identical or may vary, as shown in FIG. 2, and are preferably each between about 1 to 12 inches.

Figure 6:
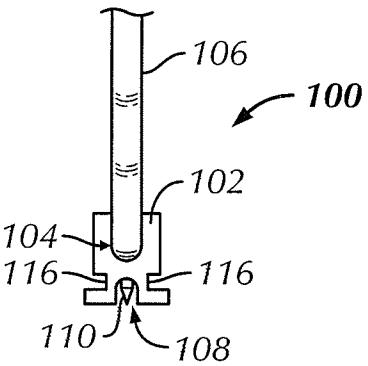
FIG. 6 is a right side elevational view of the ionizer bar of FIG. 3.
Figure 7:
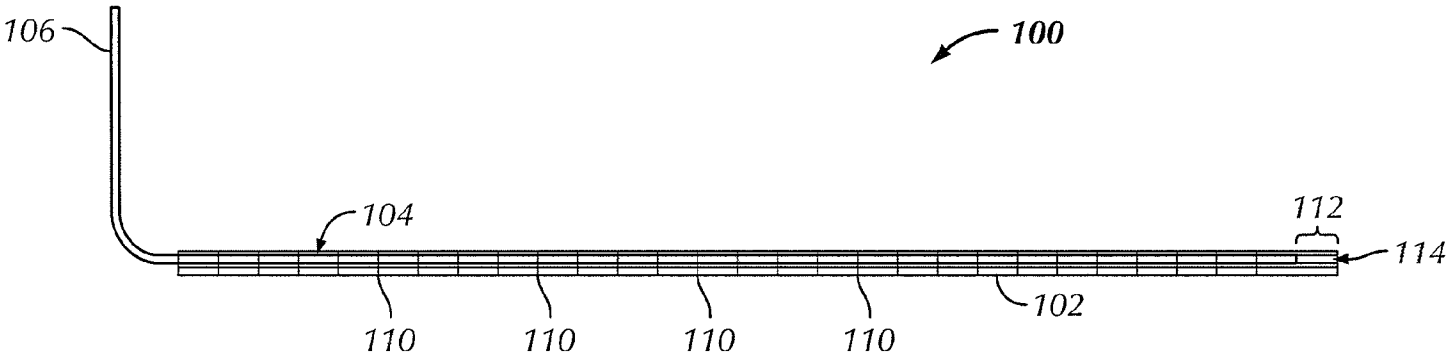
FIG. 7 is a front side elevational view of the ionizer bar of FIG. 3.

Referring to FIGS. 3, 6, and 7, an ionizer bar 100 is provided for insertion into the main body 56 to generate ions that enter the air flow 44 directed toward the applications 48, 50. The ionizer bar 100 preferably includes a housing 102 made from an insulative material, preferably polytetrafluoroethylene (PTFE), reinforced plastic, or the like. The housing 102 preferably contains at least one hollow channel 104 extending along a length of the ionizer bar 100. The hollow channel 104 is sized and shaped to receive a power cable 106 coupled to a high voltage direct current (DC) or alternating current (AC) power supply (not shown) that provides power to the ionizer bar 100. The power cable 106 is preferably an insulated cable with a conductive core and preferably supplies a voltage in the range of 8-12 kV or higher.

The housing 102 of the ionizer bar 100 also preferably includes, in a bottom surface thereof, a pin slot 108 that extends along and accesses the hollow channel 104. A plurality of pins 110 are electrically coupled to the power cable 106 and extend into the pin slot 108. The pins 110 may be directly connected, resistively connected, or capacitively connected to the high voltage power supply via the power cable 106. In the embodiment shown in the drawings, the pins 110 penetrate the insulation of the power cable 106 to establish a physical and electrical connection to the conductive core. However, in other embodiments, the pins 110 may be coupled to the power cable 106 via terminals, conductive traces, or the like. The pins 110 are preferably spaced apart in a regular pattern along the length of the housing 102 of the ionizer bar 100 in order to provide an even distribution of ions. For example, the pins 110 may be placed an inch apart from each other along the power cable 106. The pins 110 are preferably formed from a metal or semiconductor material, such as copper, aluminum, tungsten, titanium, stainless steel, silicon, silicon carbide, or the like.

The ionizer bar 100 is preferably mounted in the main body 56 of the air manifold 14 with the free end of the power cable 106 located proximate the end cap 58. To prevent a short circuit by inadvertent contact of the power cable 106 or one of the pins 110 with the main body 56, an end portion 112 of the housing 102 of the ionizer bar 100 is preferably filled with an inert or non-conductive material 114, which is preferably a polyolefin-based hot melt adhesive. Alternatively, the inert or non-conductive material 114 may be an epoxy, polyurethane, silicon-based compound, or the like.

Figure 4:
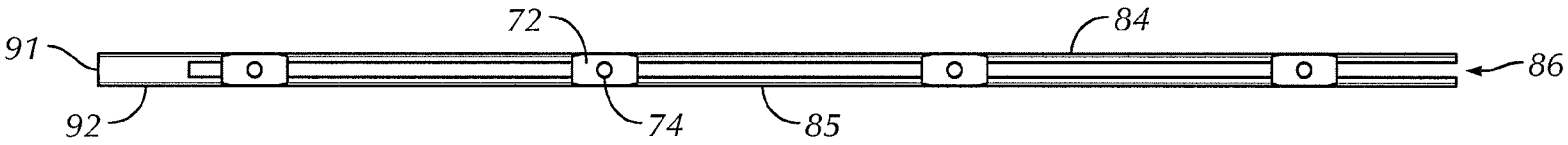
FIG. 4 is a top plan view of a cartridge for securing the ionizer bar to the air manifold in FIG. 3.
Figure 5:
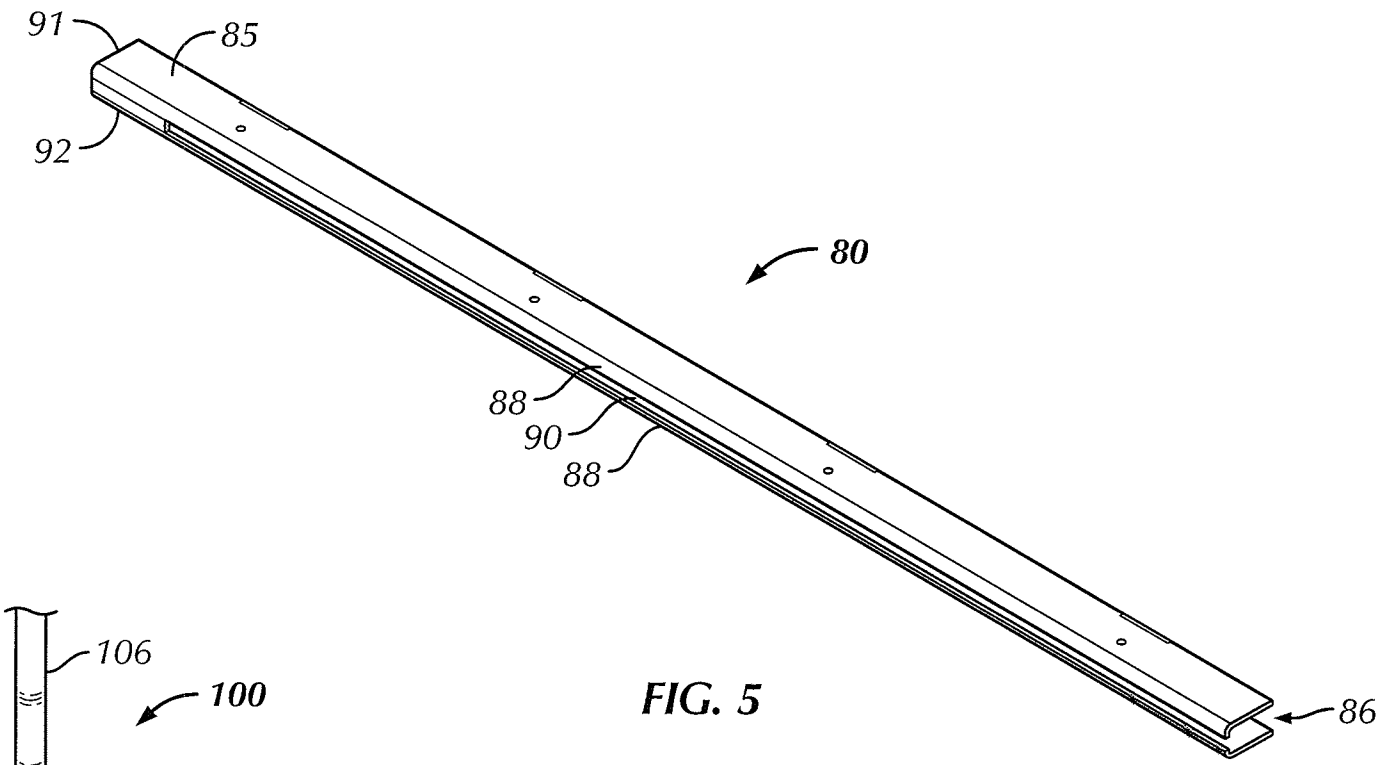
FIG. 5 is a bottom side perspective view of the cartridge of FIG. 4.

Referring to FIGS. 3-5, the ionizer bar 100 is preferably mounted within the main body 56 of the air manifold 14 by a cartridge 80. The cartridge 80 may be permanently connected to the main body 56, such as by welding or the like, but it is preferred that the cartridge 80 is releasably attached to the main body 56 instead to facilitate easier access to the ionizer bar 100 for service and/or replacement. Accordingly, the cartridge 80 may be attached to the main body 56 by way of bolts 82 or other mechanical fasteners that extend from the exterior of the main body 56 and into the cartridge 80. However, other methods of releasable attachment of the cartridge 80, such as latches, hook-and-loop fasteners, or the like may also be used. It is preferred that the cartridge 80 is attached firmly to the main body 56 to avoid movement of the cartridge 80 and ionizer bar 100 as a result of the force of the air flowing through the main body 56.

The cartridge 80 is preferably in the shape of a hollow bar having two side plates 84, 85 arranged to extend parallel to one another and along a length L of the main body 56 of the air manifold 14 when installed. The side plates 84, 85 are spaced apart from one another to form a channel 86 therebetween which is preferably sized and shaped to retain the ionizer bar 100. A bottom surface of each of the plates 84, 85 also preferably includes a lip 88 extending perpendicularly to the plates 84, 85 and toward the channel 86. The lips 88 are utilized to support the ionizer bar 100. For example, the lips 88 may abut a bottom surface of the housing 102 of the ionizer bar 100 and allow the pins 110 to extend through a slot 90 formed by the lips 88. However, it is preferred that the lips 88 engage respective grooves 116 extending along the housing 102 of the ionizer bar 100 (FIG. 6). In this way the corona discharge of the pins 110 will not be impeded by the cartridge 80. This arrangement allows for convenient insertion and removal of the ionizer bar 100 in the cartridge 80 by way of sliding the ionizer bar 100 into the channel 86. However, other methods of insertion and removal for the cartridge 80, such as clips or other mechanical fasteners, may be used as well.

Preferably the slot 90 does not extend the entire length of the cartridge 80, but rather stops short of an edge of the cartridge 80 adjacent the inlet 40 of the air manifold 14 in the installed position. The lips 88 preferably converge at this location of the cartridge 80 to form part of a spacer 92. A top portion of each plate 84, 85 also preferably converges at this location to form another part of the spacer 92. The spacer 92 also preferably includes an end cap 91. The spacer 92 seals off the end of the cartridge 80 proximate the inlet 40 of the air manifold 14 to prevent air from accessing the power cord 106 of the ionizer bar 100.

Specifically, the power cord 106 is preferably gripped by a fitting 69 and inserted into the air manifold 14 through a cord opening 68 at a top of the main body 56 proximate the inlet 40. The channel 86 of the cartridge 80 is aligned with the cord opening 68 such that when the fitting 69 is secured in the cord opening 68, the power cord 106 is immediately received in the channel 86 of the cartridge 80 and is not exposed to pressurized air entering the main body 56 through the inlet 40. However, the fitting 69 and cord opening 68 may be positioned at other locations of the air manifold 14.

A plurality of nut plates 72 are preferably provided on the top portion of the cartridge 80, each of which is welded or otherwise mechanically fastened to the plates 84, 85. Each nut plate 72 preferably includes a threaded hole 74 extending at least partially therethrough. The threaded holes 74 are preferably spaced on the cartridge 80 to align with corresponding bolt holes 75 formed in a top of the main body 56. The bolts 82 are placed through the bolt holes 75 and are threaded into the threaded holes 74 of the nut plates 72 to secure the cartridge 80 to the main body 56 of the air manifold 14 as shown in FIG. 3.

Figure 8:
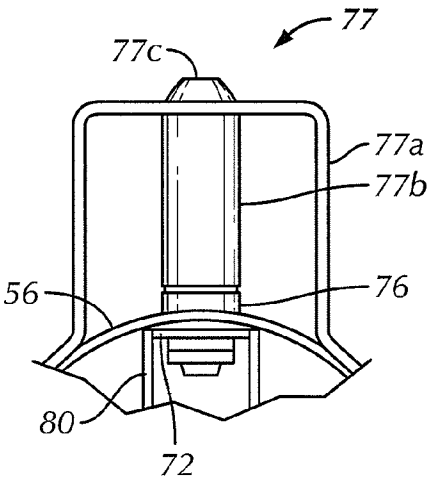
FIG. 8 is a side elevational view of an attachment tool for manufacturing the air manifold of FIG. 3 in accordance with the first preferred embodiment of the present invention.

Referring to FIG. 8, in some embodiments, the main body 56 of the air manifold 14 includes a cylindrical spacer 76 welded above the bolt holes 75 to compensate for the joining of two incompatible surfaces (e.g., the curved interior of the main body 56 and the flat nut plates 72 of the cartridge 80). In order to properly align the cylindrical spacer 76 during welding, an attachment tool 77 may be used. The tool 77 includes a spring clip 77*a*, a sleeve 77*b*, and a long bolt 77*c*. In use, a bottom portion of the spring clip 77*a* abuts a surface of the main body 56 of the air manifold while the long bolt 77*c* extends through the sleeve 77*b*, through the cylindrical spacer 76, through the bolt hole 75, and into the nut plate 72 of the cartridge 80. When the cartridge 80 is secured in the desired location and tightness, the cylindrical spacer 76 may be welded in place to the main body 56. The sleeve 77*b* is preferably made from aluminum to avoid welding of the sleeve 77*b* to the cylindrical spacer 76. Once welding is completed, the tool 77 may be removed and the regular bolts 82 are used to attach the cartridge 80 for use.

It is preferred that at least the cartridge 80, and also preferably the main body 56 of the air manifold 14, be formed from a conductive material such as stainless steel and the housing 102 of the ionizer bar 100 be made of non-conductive material. In this way, the cartridge 80 and/or the main body 56 of the air manifold function as the reference (ground) electrode for the ionizing bar 100, as opposed to the housing 102 of the ionizer bar 100 itself, or a reference electrode embedded in the housing 102, which are more commonly known arrangements for ion generation. Surprisingly, this configuration outperformed arrangements having all or portions of the air manifold 14 made from a non-conductor such as plastic in removing charge from a line of cans. However, other more conventional arrangements of the ionizer bar 100 and an insulative main body 56 and cartridge 80 may also be used.

Referring again to FIG. 1, the filter 24 prevents debris in the airstream from entering and contaminating the applications 48, 50. The filter 24 also prevents debris build-up on the pins 110 of the ionizer bar 100, thereby maximizing the ionization efficiency of the pins 110 for an extended period of time. The filter 24 also prevents contamination and/or damage in the event of upstream failures. For example, air blowers 12 will often have aluminum impellers, which in a catastrophic failure resulting in aluminum on aluminum contact can produce shavings that may enter the airstream, but will be caught by the filter 24.

The filter 24 preferably has a housing made from stainless steel or a like corrosion-resistant material. Further, the filter 24 may include media (not shown) meeting the High-efficiency particulate air (HEPA) standard (i.e., 99.97% of particles greater than 0.3 micrometers are removed). However, it has been found that a media with 99.99% efficiency at 0.5 micrometers (nominal) allows for better air flow (e.g., with only 10% of the pressure drop experienced when using HEPA filters), and is more than adequate for food and beverage container applications 48, 50. The filter 24 may further include a gauge (not shown) which notifies the user when replacement is necessary.

While only one filter 24 is shown in FIG. 1 placed between the air blower 12 and the divider 32, one or more additional filters 24 may alternatively or additionally be placed between the divider 32 and the air manifolds 40A, 40B. This configuration would be useful in, for example, systems 10 having very high pressure air flow. A filter 24 may also be placed at an inlet (not shown) of the air blower 12.

Figure 9:
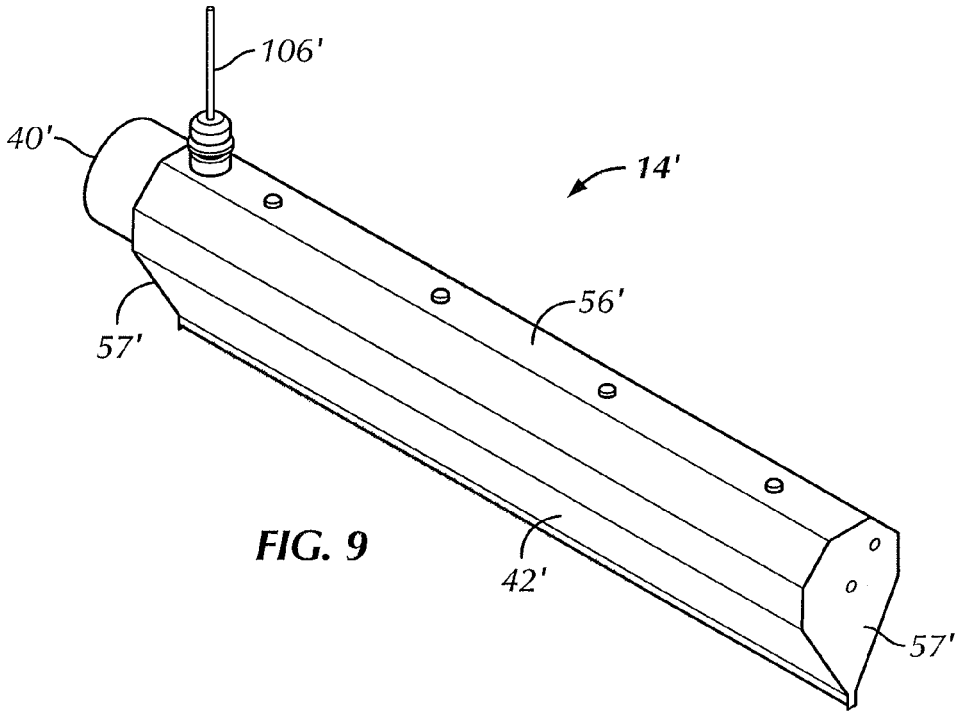
FIG. 9 is a front side perspective view of an air knife in accordance with a second preferred embodiment of the present invention.

In an alternate embodiment of the invention, the air manifold 14 may be replaced by an air knife 14', as shown in FIG. 9. The air knife 14' is constructed similarly to the air manifold 14, including the use of an inlet 40' that receives blown air from the air supply 12, but in place of the nozzles 42A-42F of the air manifold 14, the air knife 14' includes a discharge slot 42' that extends along a substantial portion of the length of the main body 56' thereof. The main body 56' includes tapered portions 57' to force the air through the discharge slot 42'. An ionizer bar 100 may be mounted within the air knife 14' using a cartridge 80 in a similar to fashion as described above.

Figure 10:
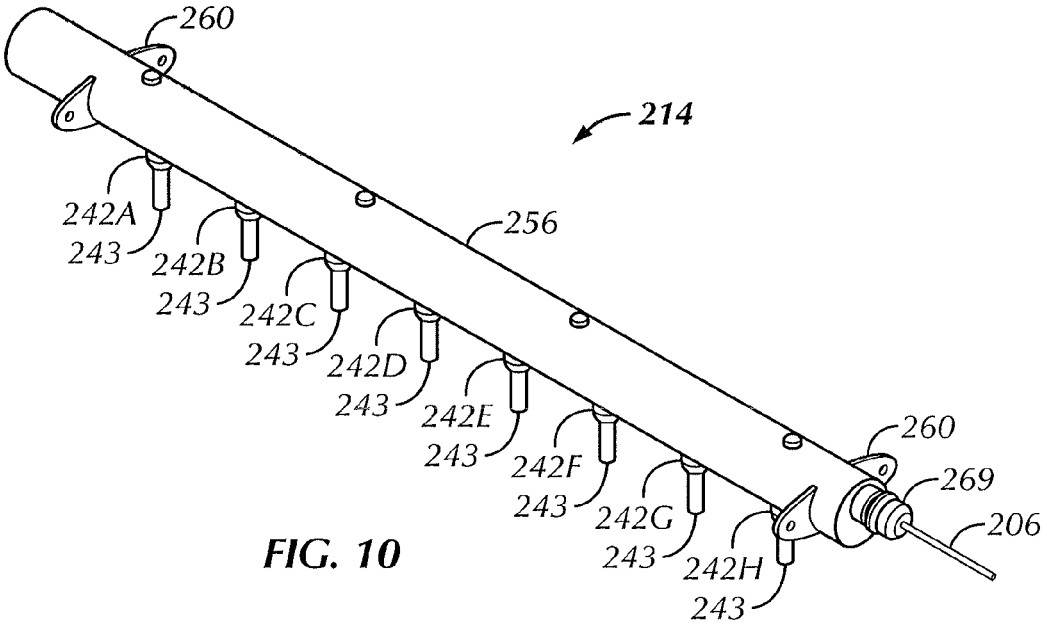
FIG. 10 is a front side perspective view of an air manifold in accordance with a third preferred embodiment of the present invention.
Figure 11:
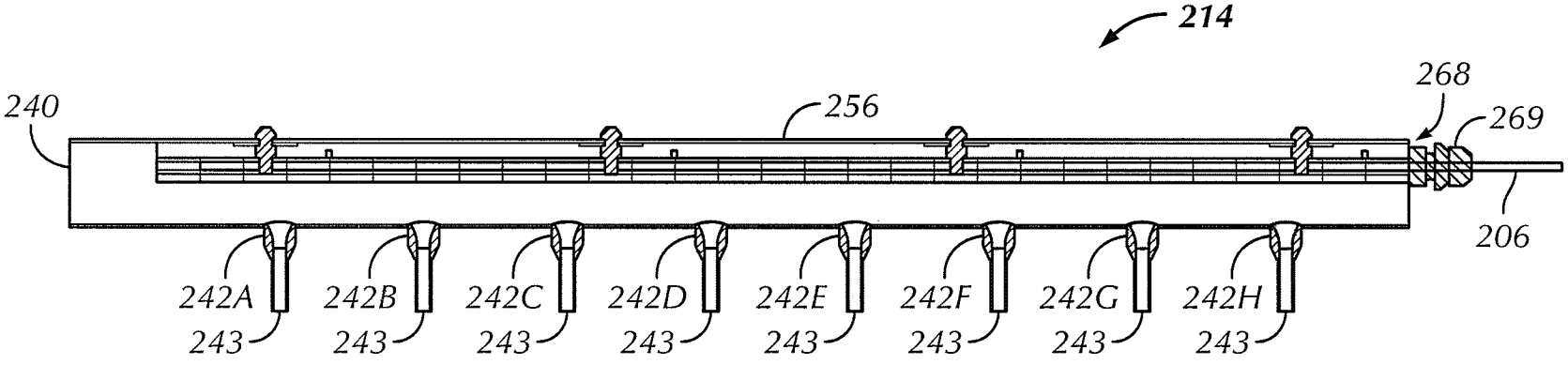
FIG. 11 a cross-sectional front side elevational view of the air manifold of FIG. 10 with the ionizer bar installed.
Figure 12:
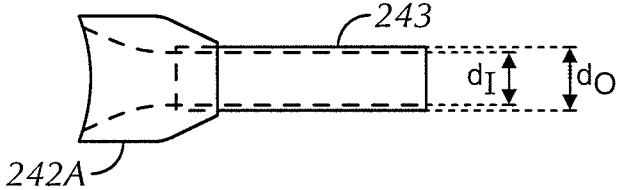
FIG. 12 side view of a nozzle and elongated cylindrical shaft coupled thereto for use in the air manifold of FIG. 10.

FIGS. 10-12 show another embodiment of the invention specifically designed for use in cleaning bottles (not shown), which typically have small openings. The air manifold of FIGS. 10-12 is similar to the embodiment shown in FIGS. 1-8, and like numerals have been used for like elements, except the 200 series numerals have been used for the embodiment shown in FIGS. 10-12. Accordingly, a complete description of the embodiment of FIGS. 10-12 has been omitted, with only the differences being described.

As can be seen in FIGS. 11 and 12, an elongated cylindrical shaft 243 having a constant inner diameter $d_I$ may be connected to an outlet of each of the nozzles 242A-242H. The elongated cylindrical shaft 243 does not further compress the air flow through the respective nozzle 242A-242H, but rather maintains the pressure of the air flow 44 at a relative constant. The elongated cylindrical shaft 243 is used to guide the air flow 44 to the small opening of a bottle, for example. The outer diameter $d_O$ of the elongated cylindrical shaft 243 is also preferably constant along a length thereof. It is particularly preferable in the bottle cleaning application that the inner diameter $d_I$ be maximized for air delivery into the bottle while the outer diameter $d_O$ is minimized so that air leaving the bottle opening can escape past the elongated cylindrical shaft 243. In a preferred embodiment, the inner diameter $d_I$ is about 5/16 of an inch while the outer diameter $d_O$ is about 3/8 of an inch.

The elongated cylindrical shaft 243 is preferably friction fit and/or welded to the corresponding air nozzle 242A-242H. However, other methods of attachment, such as adhesive, mechanical fasteners, or the like may be used as well. The elongated cylindrical shaft 243 may also be removable for replacement and/or use of the nozzles 242A-242H without the shafts 243.

FIGS. 10 and 11 also show an alternative arrangement for attaching the power cable 206, preferably gripped by a fitting 269, to the air manifold 214. Rather than being located at a top or radial surface of the main body 256, the cord opening 268 is provided at the sealed end of the main body 256 opposite to the inlet 240. FIG. 10 also shows a slightly different arrangement of the brackets 260. As previously described, these changes may be made to accommodate the mounting requirements of the air manifold 14, 214 and are not limited by the invention.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

What is claimed is:

1. A processing system comprising:

an air blower;

an air manifold comprising a main body having an inlet coupled to the air blower and a plurality of outlet openings, each of the outlet openings being coupled to a nozzle;

an ionizer bar comprising a housing, a power cable contained within the housing, and a plurality of emitter pins electrically coupled to the power cable; and a cartridge including two side plates forming a channel in which the ionizer bar is mounted, the cartridge being removably couplable to an interior of the main body of the air manifold.

2. The system of claim 1, wherein at least one of the cartridge or the main body of the air manifold is formed of a conductive material.

3. The system of claim 2, wherein the housing of the ionizer bar is formed of a non-conductive material.

4. The system of claim 3, wherein the at least one of the cartridge or the main body forms a reference electrode for the ionizer bar.

5. The system of claim 1, further comprising a plurality of hollow, elongated cylindrical shafts, each of which is coupled to one of the plurality of nozzles for receiving and emitting air output by the nozzles.

6. The system of claim 5, wherein an inner diameter of each of the cylindrical shafts is constant along a length thereof.

7. The system of claim 6, wherein an outer diameter of each of the cylindrical shafts is constant along a length thereof, the inner diameter being about 5/16 of an inch and the outer diameter being about 3/8 of an inch.

8. The system of claim 1, wherein each of the two side plates of the cartridge includes a lip extending perpendicularly therefrom toward the channel, the lips forming a slot extending longitudinally along the cartridge.

9. The system of claim 8, wherein the housing of the ionizer bar includes a pair of longitudinally extending grooves on opposing sides of the housing, the lips of the cartridge being configured to engage respective ones of the grooves on the housing when the ionizer bar is installed in the cartridge such that the emitter pins extend through the slot.

10. The system of claim 1, wherein an end of the housing of the ionizer bar opposite to the inlet opening is filled with a non-conductive material.

11. The system of claim 10, wherein the non-conductive material is a polyolefin-based hot melt adhesive.

12. The system of claim 1, wherein the cartridge is removably coupled to the interior of the main body of the air manifold by a plurality of bolts extending from an exterior of the main body of the air manifold to the interior and into the cartridge.

13. The system of claim 12, wherein the cartridge includes a plurality of nut plates each having a threaded hole, each of the bolts being received in a corresponding threaded hole.

14. The system of claim 1, wherein a cable opening is provided in the main body of the air manifold at a radial outer surface thereof, the cable opening receiving the power cable of the ionizer bar.

15. The system of claim 14, wherein the cable opening is proximate to the inlet opening.

16. The system of claim 1, wherein a cable opening is provided in the main body of the air manifold at a sealed end opposite to the inlet opening, the cable opening receiving the power cable of the ionizer bar.

17. The system of claim 1, wherein the cartridge includes a spacer at an end thereof that is adjacent to the inlet opening when the cartridge is installed in the air manifold.

18. The system of claim 1, further comprising a filter arranged between the air blower and the inlet of the main body of the air manifold.

* * * * *